US010001268B2

(12) United States Patent
Kim

(10) Patent No.: US 10,001,268 B2
(45) Date of Patent: Jun. 19, 2018

(54) AIR-COOLED LED LIGHT WITH SEPARATION PLATE

(71) Applicant: LUNEX CO., LTD., Daegu (KR)

(72) Inventor: Jang Hee Kim, Daegu (KR)

(73) Assignee: LUNEX CO., LTD., Daegu (KR)

( * ) Notice: Subject to any disclaimer, the term of this patent is extended or adjusted under 35 U.S.C. 154(b) by 0 days. days.

(21) Appl. No.: 15/319,869

(22) PCT Filed: Jun. 5, 2015

(86) PCT No.: PCT/KR2015/005685

§ 371 (c)(1),
(2) Date: Dec. 19, 2016

(87) PCT Pub. No.: WO2015/194778

PCT Pub. Date: Dec. 23, 2015

(65) Prior Publication Data

US 2017/0138582 A1 May 18, 2017

(30) Foreign Application Priority Data

Jun. 17, 2014 (KR) ..... 10-2014-0073656

(51) Int. Cl.

| | |
|---|---|
| ***F21V 29/00*** | (2015.01) |
| ***F21V 29/67*** | (2015.01) |
| ***F21V 29/83*** | (2015.01) |
| ***F21V 29/76*** | (2015.01) |
| ***F21V 23/02*** | (2006.01) |

(Continued)

(52) U.S. Cl.

CPC ..... *F21V 29/677* (2015.01); *F21V 21/08* (2013.01); *F21V 23/02* (2013.01); *F21V 29/673* (2015.01); *F21V 29/76* (2015.01); *F21V 29/83* (2015.01); *F21Y 2115/10* (2016.08)

(58) Field of Classification Search

CPC ..... F21V 29/67–29/677

See application file for complete search history.

(56) References Cited

U.S. PATENT DOCUMENTS

2012/0033419 A1* 2/2012 Kim ..... F21S 8/026 362/235

FOREIGN PATENT DOCUMENTS

| | | |
|---|---|---|
| JP | 2013020941 | 1/2013 |
| JP | 2013048026 | 3/2013 |

(Continued)

OTHER PUBLICATIONS

International Search Report—PCT/KR2015/005685 dated Jul. 21, 2015.

*Primary Examiner* — Sean Gramling
(74) *Attorney, Agent, or Firm* — Cantor Colburn LLP

(57) ABSTRACT

Provided is an air-cooled LED light having an LED substrate with an LED mounted thereon, and a casing with the LED substrate mounted thereon, the casing including: an inlet port through which air flows in; an outlet port through which the air fed from the inlet port is discharged; an separation plate that is interposed between the inlet port and the outlet port to divide an inner space of the casing; an opening that is formed in the separation plate; and a fan that is disposed on the separation plate in line with the opening of the separation plate. It is possible to prevent the air filled in the lower portion of the separation plate from flowing backward to an upper portion of the separation plate thereby to improve the cooling efficiency.

4 Claims, 5 Drawing Sheets

(51) Int. Cl.
*F21V 21/08* (2006.01)
*F21Y 115/10* (2016.01)

(56) References Cited

FOREIGN PATENT DOCUMENTS

| | | |
|---|---|---|
| KR | 1020060062104 | 6/2006 |
| KR | 100907618 | 7/2009 |
| KR | 20120013880 | 2/2012 |

* cited by examiner

AIR-COOLED LED LIGHT WITH SEPARATION PLATE

TECHNICAL FIELD

The present invention relates to an air-cooled LED light with a separation plate, and, more particularly, to an air-cooled LED light with a separation plate which can prevent cooling efficiency from deteriorating due to mixing of air to be fed (hereinafter referred to as cold air) and air to be discharged (hereinafter referred to as hot air).

BACKGROUND ART

A configuration and operation of an LED light 1 according to the related art will now be described with reference to the accompanying drawing.

FIG. 1 is a cross-sectional view illustrating an LED light according to the related art.

The LED light of the related art includes an LED substrate 10 and a heat sink 20 mounted on the LED substrate 10 to radiate heat. Also, the LED light includes a fan 30 mounted on the heat sink 20 to feed air, and an inner tubular body 40 configured to receive the fan 30, through which the air flows to the fan from a top. In addition, the LED light includes an outer body 50 configured to house all of the components described above, of which a lower portion is opened, and a transparent plate 60 for covering the opened lower portion of the outer body 50.

The outer body 50 is provided with an inlet port 51 for sucking the air, and an outlet port 53 for discharging the air from an inside. The inlet port 51 is located at an upper portion of a side of the outer body, and the outlet port 53 is located at a lower portion of the outer body 50.

The LED substrate 10 is configured to be supported in the outer body 50.

The heat sink 20 is disposed so that radiation fins 23 face up. After the air sucked from the top by the fan 30 is fed to gaps between the radiation fins 23, the air is discharged to the side by the radiation fins 23.

A converter 70 is provided in the outer body 50 to convert an AC power to a DC power and supply it to the LED substrate 10.

Explaining the operation of the LED light 1 according to the related art, a power is applied to the LED substrate 10 and the fan 30, thereby turning on the LED mounted on the LED substrate 10 and operating the fan 30. The air sucked through the inlet port 51 by operation of the fan 30 is fed to the radiation fins 23 of the heat sink 20 from the fan 30 through the inner body 40. The air is discharged from the side of the radiation fins 23 through the outlet port 53. Therefore, since the air cools the heat sink 20 absorbing the heat from the LED substrate 10, it is possible to prevent the LED substrate 10 from overheating.

A part of the air sucked by the outer body 50 absorbs the heat from the converter 70, and then is fed to the radiation fins 23 to absorb the heat from the heat sink 20. After that, the air is discharged from the outer body.

The LED light of the related art has problems as follows.

First, its cooling efficiency is low. In other words, after the air fed to the radiation fins 23 by the fan 30 is discharged along the radiation fins 23, a part of the hot air is discharged through the outlet port 53, while other part moves upwardly and then is mixed with the cold air sucked through the inlet port 51. As a result, a temperature of the cold air is raised, and thus the cooling efficiency is lowered. Also, there is another problem in that the hot air discharged through the outlet port 53 is again fed to the inlet port 51, thereby further lowering the cooling efficiency. Since the above phenomenon is continuously repeated while the power is applying, the internal temperature of the outer body 50 is gradually raised, and thus a lifetime of the LED substrate 10 and the converter is shortened.

Also, since the heat sink 20 is provided, the whole weight of the LED light 1 is increased. Therefore, it is difficult to mount the LED light at a high point, such as a pole of a streetlamp or a ceiling, and a manufacturing cost is increased.

CITED DOCUMENTS

Patent Document

Patent Document 1—Korean Patent No. 10-0907618 (Jul. 6, 2009)

DISCLOSURE

Technical Problem

Therefore, an object of the present invention is to provide an air-cooled LED light with a separation plate which can improve cooling efficiency by preventing cold air sucked by a fan and hot air to be discharged from mixing. In other words, after the cold air sucked by the fan absorbs heat, the hot air is directly discharged to an outside. Also, the hot air discharged to the outside is not fed to an inside through an inlet port.

Another object of the present invention is to provide an air-cooled LED light with a separation plate which is not provided with a heat sink, thereby lowering a manufacturing cost and a weight and being easily mounted to a pole of a streetlamp or a ceiling.

Technical Solution

According to one aspect of the present invention, there is provided an air-cooled LED light having an LED substrate with an LED mounted thereon, and a casing with the LED substrate mounted thereon, the casing including: an inlet port through which air flows in; an outlet port through which the air fed from the inlet port is discharged; an separation plate that is interposed between the inlet port and the outlet port to divide an inner space of the casing; an opening that is formed in the separation plate; and a fan that is disposed on the separation plate in line with the opening of the separation plate.

Also, the casing includes a lower cylindrical casing that is disposed at a lower portion of the casing, the LED substrate being mounted onto a bottom surface of the lower casing, an upper casing configured to cover the lower casing, and a flange interposed between the upper casing and the lower casing. The inlet port is formed in an upper portion of the flange and the outlet port is formed in a lower portion of the flange. The separation plate is selectively supported by the lower casing or the upper casing so that the separation plate is interposed between the inlet port and the outlet port.

The lower casing is provided on a bottom surface thereof with a plurality of ribs.

The flange includes a plurality of rings which are vertically positioned to form the inlet port and the outlet port, and a protrusion which is interposed between the rings so that the rings are spaced apart from each other.

The ring is formed in a shape of a disc-type rim, of which an outer rim portion positioned at an outside on the basis of the protrusion faces down, while an inner rim portion faces up.

The separation plate is brought into close contact with the inner rim portion of the ring which is interposed between the inlet port and the outlet port, or is integrally formed with the inner rim portion.

Advantageous Effects

With the above configuration of the air-cooled LED light with the separation plate according to the present invention, there are advantageous effects as follows.

The separation plate can prevent a phenomenon in which the hot air to be discharged is mixed with the cold air to be sucked. In other words, it is possible to prevent the air filled between the separation plate and the lower casing from flowing backward to the upper portion of the separation plate thereby to improve cooling efficiency.

Because of the improved cooling efficiency, the LED substrate and the converter can be effectively cooled, without using a heat sink. Also, since the heat sink is not utilized, the weight of the LED light is decreased, and a manufacturing cost is lowered.

MODE FOR INVENTION

The configuration and operation of an air-cooled LED light according to the present invention will now be described in detail with reference to the accompanying drawings.

Figure 1:
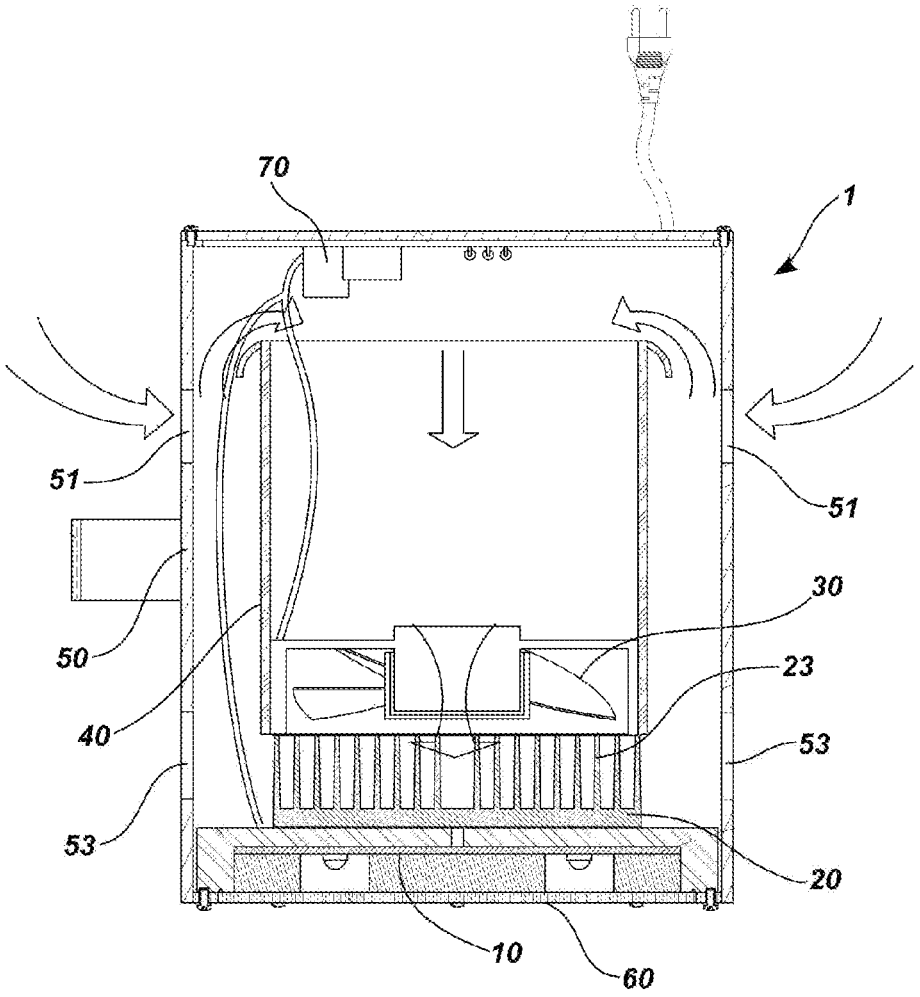
FIG. 1 Prior Art
FIG. 1 is a cross-sectional view illustrating an LED light according to the related art.
Figure 2:
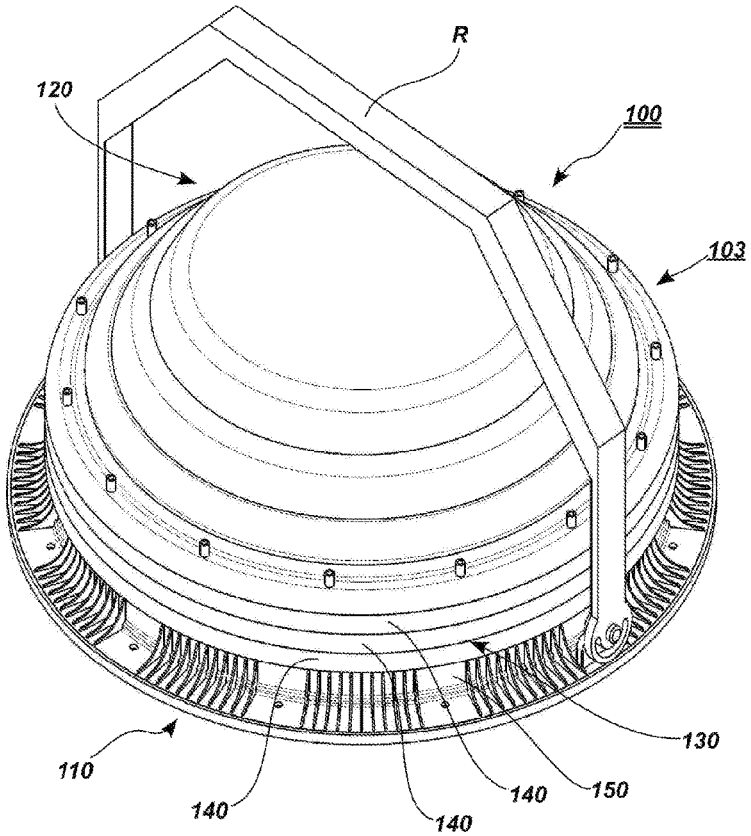
FIG. 2 is a perspective view illustrating an air-cooled LED light with a separation plate according to the present invention.
Figure 3:
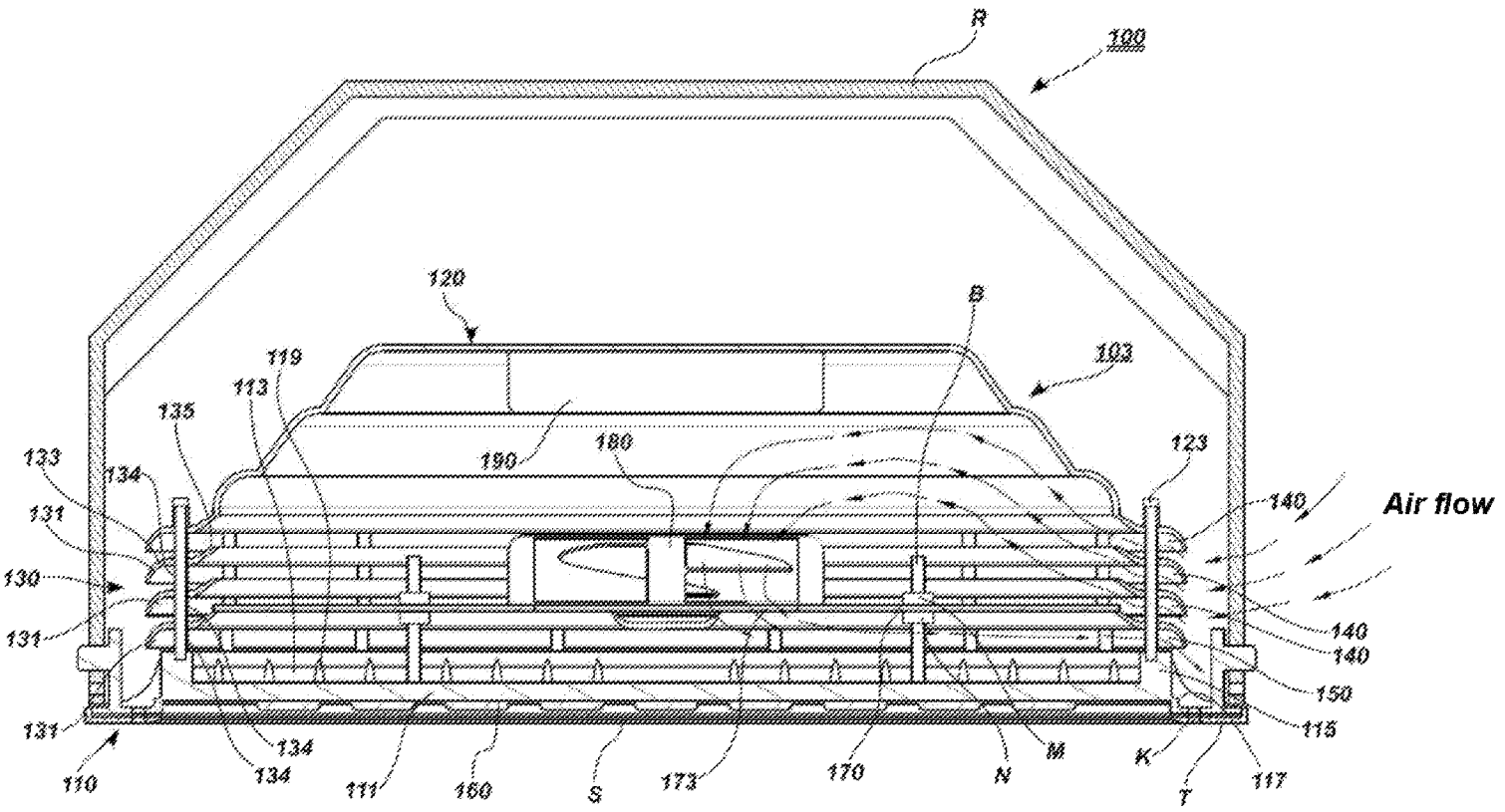
FIG. 3 is a cross-sectional view illustrating the air-cooled LED light with the separation plate according to the present invention.
Figure 4:
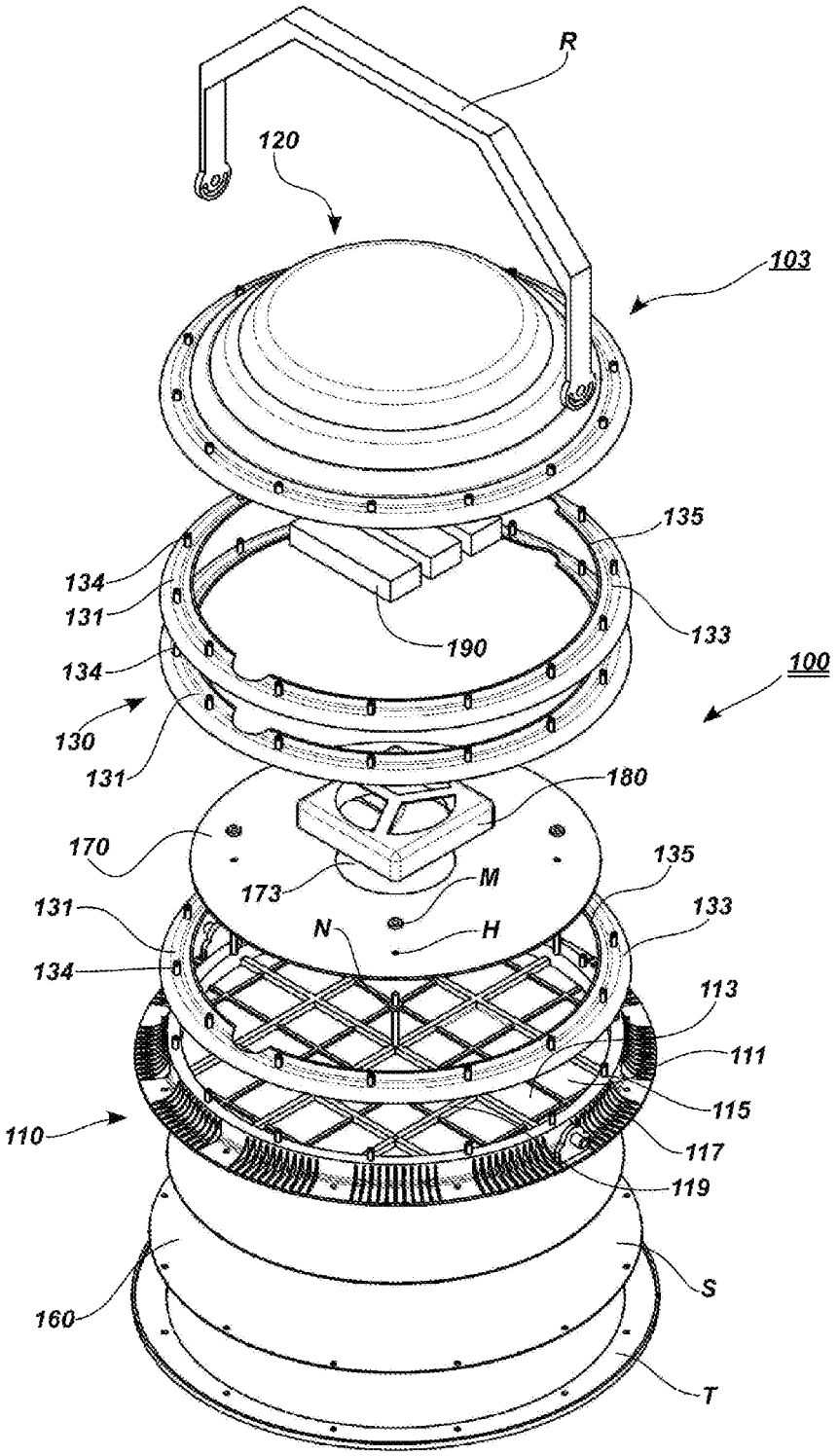
FIG. 4 is an exploded perspective view illustrating the air-cooled LED light with the separation plate according to the present invention.
Figure 5:
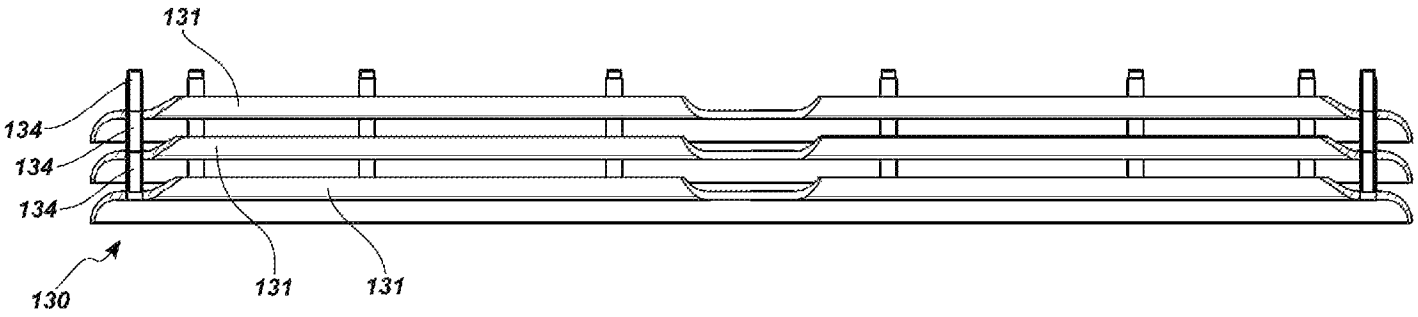
FIG. 5 is a cross-sectional view illustrating only layered rings of the air-cooled LED light with the separation plate according to the present invention.

FIG. 2 is a perspective view illustrating an air-cooled LED light with a separation plate according to the present invention. FIG. 3 is a cross-sectional view illustrating the air-cooled LED light with the separation plate according to the present invention. FIG. 4 is an exploded perspective view illustrating the air-cooled LED light with the separation plate according to the present invention. FIG. 5 is a cross-sectional view illustrating only layered rings of the air-cooled LED light with the separation plate according to the present invention.

The LED light generally includes an LED substrate 160 with an LED mounted thereon, and a casing 103 with the LED substrate 160 mounted thereon. Also, the LED light includes a converter 190 disposed in the casing 103 to convert an AC power to a DC power and to supply it to the LED substrate 160.

The air-cooled LED light according to the embodiment is characterized in that after air is forcibly fed to an inside of the casing 103 to absorb heat, the LED light is configured to discharge the hot air without being mixed with cold air, thereby improving cooling efficiency.

To this end, the LED light of the embodiment is configured as follows.

As illustrated in FIGS. 2 and 3, the casing 103 is provided with an inlet port 140, through which air flows, and an outlet port 150, through which the air fed through the inlet port 140 is discharged. A separation plate 170 is interposed between the inlet port 140 and the outlet port 150 to divide an inner space of the casing 103. The separation plate 170 is provided with an opening 173, and a fan 180 is disposed on the separation plate 170 in line with the opening 173 of the separation plate 170. The fan 180 may be mounted onto a top surface of the separation plate 170.

Expanding the configuration according to the embodiment in detail with reference to FIG. 4, the casing 103 includes a lower cylindrical casing 110 disposed at a lower portion of the casing, with the LED substrate 160 being mounted onto a bottom surface thereof, and an upper casing 120 configured to cover an upper portion of the lower casing 110. Also, a flange 130 is interposed between the upper casing 120 and the lower casing 110. The inlet port 140 is formed in the upper portion of the flange 130 and the outlet port 150 is formed in the lower portion of the flange. The separation plate 170 is selectively supported by the lower casing 110 or the upper casing 120 so that the separation plate is interposed between the inlet port 140 and the outlet port 150.

The lower casing 110 has a bottom plate 111 and a side wall 115 protruding upwardly from an edge of the bottom plate 111. The LED substrate 160 is mounted onto the bottom surface of the bottom plate 111, and a transparent plate S is disposed below the LED substrate 160, and is attached to the lower casing 110. According to an embodiment, a ring T is attached to the bottom surface of the transparent plate S, and the ring T and the transparent plate S are fastened to the lower casing 110 by screws K. The lower casing 110 may be formed with threaded holes to which the screws K are fastened.

Since the LED substrate 160 has a width smaller than that of the transparent plate S, the screw K does not penetrate the LED substrate 160. A plurality of radiation fins 117 protrude from an edge of the side wall 115 to easily transfer the heat generated from the LED substrate 160 through the bottom plate 111 and the side wall 115. Also, a plurality of ribs 119 protrude from the bottom surface 113 of the lower casing 110, that is, the top surface of the bottom plate 111, thereby delaying a time of the inflow air staying on the lower casing 110 and thus improving the effectiveness of the heat exchange.

A plurality of bolts B are supported by the bottom surface 113 in a standing state to support the separation plate 170. In other words, the bolts B are inserted into through-holes H of the separation plate 170, and the separation plate 170 is supported by fastening nuts N to the bolts B. Since the nut N has a width wider than a diameter of the through-hole H, the separation plate 170 is positioned by the nuts N which abut against the through-holes H.

As described above, if the nuts N are fastened to the bolts B penetrating through the through-holes H to press the top surface of the separation plate 170, it is possible to prevent the separation plate 170 from being released.

The upper casing 120 is formed in the shape of a cylinder with a bottom opened, and the converter 190 is attached to an inner top surface of the upper casing 120.

The flange 130 has a plurality of rings 131 which are vertically positioned to form the inlet port 140 and the outlet port 150, and protrusions 134 are interposed between the rings 131 so that the rings 131 are spaced apart from each other.

The protrusions 134 may be integrally or detachably formed on a bottom surface of am top surface of the ring 131. As illustrated in FIGS. 4 and 5, if the rings 131 are positioned to be stacked in a vertical direction, the air can flow between the rings 131. After the stacked flange 130 is put on the lower casing 110, the upper casing 120 is brought into contact with the upper portion of the flange 130. After that, screws 123 are fastened to the lower casing 110 through the respective rings 131, and thus the upper casing 120, the flange 130 and the lower casing 110 are fastened to each other.

The screw 123 is preferably configured to penetrate the protrusion 134, thereby preventing the screw 123 from being exposed. The lower casing 110 is provided with threaded holes to which the screws 123 are fastened.

The ring 131 is formed in the shape of a disc-type rim, of which an outer rim portion 133 positioned at the outside on the basis of the protrusion 134 faces down, while an inner rim portion 135 faces up. Accordingly, the outer rim portion 133 prevents rail water from flowing in the LED light, and the inner rim portion 135 guides the flow of the air to the inner portion of the upper casing 120. Therefore, after the air absorbs the heat generated from the converter 190, the air is sucked by the fan 180 disposed at the lower portion.

The separation plate 170 is brought into contact with the top surface of the inner rim portion 135 of the ring 131 which is interposed between the inlet port 140 and the outlet port 150, so as to completely cover the inner rim portion 135. Therefore, the inner space of the casing 103 is completely separated into the upper and lower portions by the separation plate 170.

A U-shaped hook R is pivotally mounted to the lower casing 110, so that the LED light can be suspended from a high position.

The operation of the air-cooled LED light according to the embodiment will now be described with reference to FIGS. 3 and 5.

When the power is applied to the converter 190, the LED substrate 160 and the fan 180 are turned on, so that the LED mounted on the LED substrate 160 irradiates the light and the fan 180 turns. At that time, the heat is generated from the converter 190 and the LED substrate 160.

The air flows through the inlet port 140, that is, between the rings 131 disposed above the separation plate 170 by operation of the fan 180. The inflow air is fed to the upper inner portion of the upper casing 120 along the inner rim portion 135 of the ring 131. The air absorbs the heat generated from the converter 190 fixed to the top surface of the upper casing 120, and then is fed to the lower portion of the separation plate 170 by the fan 180 located at the lower portion. The flow of the air fed to the lower casing 110 is delayed by the ribs 119 protruding from the bottom surface 113, thereby effectively absorbing the heat generated from the lower casing 110. If there is no rib 119, the air will be quickly discharged as compared with the case where the ribs 119 are provided, the effectiveness of the heat exchange will be deteriorated. The separation plate 170 can prevent the air absorbing the heat, which is generated from the lower casing 110, from flowing backward to the upper portion of the separation plate 170, that is, the upper casing 120. Accordingly, it is possible to prevent a phenomenon in which the air fed through the inlet port 140 eddies between the lower casing 110 and the upper casing 120 to raise the temperature of the air newly fed and thus lower the cooling efficiency. The air absorbing the heat generated from the lower casing 110 is discharged through the outlet port 150. At that time, the air is discharged from the lower portion of the ring 131 disposed below the separation plate 170. In this instance, since the outer rim portion 133 of the ring 131 faces down, the air is discharged in the downward direction. As a result, the hot air is not mixed with the air to be newly sucked through the inlet port 140, thereby preventing the temperature of the air newly fed from being raised and thus increasing the cooling efficiency.

With the above configuration of the present invention, the separation plate 170 can prevent the phenomenon in which the hot air to be discharged is mixed with the cold air to be sucked. In other words, it is possible to prevent the air filled between the separation plate 170 and the lower casing 110 from flowing backward to the upper portion of the separation plate 170 thereby to improve the cooling efficiency. Therefore, the LED substrate 160 and the converter 190 can be effectively cooled, without using a heat sink. Also, since the heat sink is not utilized, the weight of the LED light is decreased, and a manufacturing cost is lowered.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. An air-cooled LED light having an LED substrate (160) with an LED mounted thereon, and a casing (103) with the LED substrate (160) mounted thereon, the casing (103) comprising:

an inlet port (140) through which air flows in;

an outlet port (150) through which the air fed from the inlet port (140) is discharged;

an separation plate (170) that is interposed between the inlet port (140) and the outlet port (150) to divide an inner space of the casing (103);

an opening (173) that is formed in the separation plate (170);

a fan (180) that is disposed on the separation plate (170) in line with the opening (173) of the separation plate (170);

a lower cylindrical casing (110) that is disposed at a lower portion of the casing, the LED substrate (160) being mounted onto a bottom surface of the lower casing; and an upper casing configured to cover the lower casing (110), wherein the separation plate (170) is selectively supported by the lower casing (110) or the upper casing (120) so that the separation plate is interposed between the inlet port (140) and the outlet port (150), and the inlet port (140) is disposed above the separation plate (170) and the outlet port (150) is disposed below the separation plate;

wherein the LED light further comprises a flange (130) that is disposed along an outer peripheral surface of the separation plate (170), the inlet port (140) is formed in an upper portion of the flange (130) and the outlet port (150) is formed in a lower portion of the flange, and the flange (130) is brought into contact with the outer peripheral surface of the separation plate (170) or is integrally formed with the outer peripheral surface; and wherein the flange (130) includes a plurality of rings (131) which are vertically positioned to form the inlet port (140) and the outlet port (150), and a protrusion (134) which is interposed between the rings (131) so that the rings (131) are spaced apart from each other.

2. The air-cooled LED light according to claim 1, wherein the lower casing (110) is provided on a bottom surface (113) thereof with a plurality of ribs (119).

3. The air-cooled LED light according to claim 1, wherein the ring (131) is formed in a shape of a disc-type rim, of which an outer rim portion (133) positioned at an outside on the basis of the protrusion (134) faces down, while an inner rim portion (135) faces up.

4. The air-cooled LED light according to claim 1, wherein the separation plate (170) is brought into contact with the inner rim portion (135) of the ring (131) which is interposed between the inlet port (140) and the outlet port (150).

* * * * *